US005222584A

United States Patent [19]

Zouzoulas

[11] Patent Number: 5,222,584

[45] Date of Patent: Jun. 29, 1993

[54] CURRENCY VALIDATOR

[75] Inventor: John Zouzoulas, West Chester, Pa.

[73] Assignee: Mars Incorporated, McLean, Va.

[21] Appl. No.: 687,225

[22] Filed: Apr. 18, 1991

[51] Int. Cl.[5] ..... G07F 7/04

[52] U.S. Cl. ..... 194/207; 209/534

[58] Field of Search ..... 194/206, 207; 209/534

[56] References Cited

U.S. PATENT DOCUMENTS

| | | | |
|---|---|---|---|
| 4,249,552 | 2/1981 | Margolin et al. | 194/207 |
| 4,510,380 | 4/1985 | Uchida et al. | 194/206 |
| 4,628,194 | 12/1986 | Dobbins et al. | 235/379 |
| 4,678,072 | 7/1987 | Kobayashi et al. | 194/206 |
| 4,722,519 | 2/1988 | Zouzoulas | 271/181 |
| 4,765,607 | 8/1988 | Zouzoulas | 271/177 |
| 4,775,824 | 10/1988 | Barnes et al. | 318/567 |
| 4,834,230 | 5/1989 | Kondo et al. | 194/206 |
| 4,858,744 | 8/1989 | Dolejs et al. | 194/206 |
| 4,880,096 | 11/1989 | Kobayashi et al. | 194/206 |
| 5,005,688 | 4/1991 | Yukimoto et al. | 194/206 |

*Primary Examiner*—F. J. Bartuska

*Attorney, Agent, or Firm*—Davis Hoxie Faithfull & Hapgood

[57] ABSTRACT

An improved currency validator apparatus adaptable to be assembled in either a validator up-stacker, down-stacker, or stacker-less configuration is disclosed. A motor bracket housing and an optics housing interconnect to form a bill passageway. The housings contain optical and magnetic sensors, permit the easy re-positioning of a magnetic sensor and an opposing pinch roller assembly, and preferably are made of a translucent red plastic material. The red plastic material permits the unobstructed transmission of infra-red light from an infra-red sensor, and further acts to indicate the position of the banknote entryway when illuminated by the optical sensors. An improved pinch roller assembly which automatically adjusts to the way in which the magnetic sensor is seated is also described. Further, an encoder positioned on the motor drive shaft, and accompanying slotted optical sensor, provide greater accuracy regarding bill position in the validator.

6 Claims, 7 Drawing Sheets

CURRENCY VALIDATOR

BACKGROUND OF THE INVENTION

The present invention relates to an improved currency validator and an improved method of making such a validator. More particularly, it relates to a currency validator which has been designed so that it is adaptable for assembly as either an up-stacker, a down-stacker or a stacker-less unit with only minor modifications.

Currency validator-stacker configurations presently exist which are known as up-stacker or down-stacker units, dependent on how the unit fits into a vending machine. Examples of validator up-stacker units are shown in U.S. Pat. Nos. 4,722,519, 4,765,607, and 4,775,824, all assigned to the assignee of the present application.

It is also known to use magnetic sensors in currency validators to validate and denominate banknotes. See, for example, U.S. Pat. No. 4,628,194, assigned to the assignee of the present application, which discloses a method and apparatus for improved currency validation. In the validator of that patent, a magnetic sensor is disclosed as preferably located above the passageway along which banknotes are transported through the validator. As a result, banknotes such as U.S. banknotes must be inserted portrait side up. Due to the positioning of currency sensors in various prior art units that require currency or banknote insertion portrait side up, prior art down-stacker configurations have typically required a validator of different design for connection to the stacker than the validator used for an up-stacker.

Further, a banknote must typically pass very close to or contact a magnetic sensor for accurate data to be gathered. In the prior art unit of U.S. Pat. No. 4,628,194 or other prior art units, if the magnetic sensor is not properly seated in its housing sensing errors can occur. Further, some prior art arrangements designed to bias a banknote towards the magnetic sensor employed too much pressure, resulting in jamming of the bill in the passageway.

Finally, the accurate determination of bill position in the validator passageway was another problem encountered by some currency validators. Integrated motor and encoder assemblies were used to monitor the motor in order to track the progress of a bill or banknote as it travelled through the validator. This arrangement led to bill positioning errors because of the backlash that occurred in the gearing of the motor drive train when the motor was braked. The backlash caused the bill to move slightly further in the passageway after the motor stopped, a phenomenon not monitored by the integrated motor and encoder assembly. As the validator aged, this backlash problem increased, resulting in the incorrect validation of some banknotes and other problems.

SUMMARY OF THE INVENTION

The currency validator apparatus of the present invention includes a motor bracket housing and an optics housing which interlock to form a banknote passageway. The housings comprise support receptacles for a plurality of sensors which face the banknote passageway, openings for other sensor and bill transport components, and also include interconnection means for use with a banknote stacker. A motor bracket assembly connects to the motor bracket housing, and contains a motor and belt drive assembly which operates to transport inserted banknotes. An optics bracket connects to the optics housing, and contains a pair of wheel assemblies which oppose the belt drive assembly.

As noted above, a convention in the banknote validation field typically requires U.S. banknotes to be inserted into a validator portrait-side up. Since magnetic information resides on the portrait side of U.S. banknotes, a magnetic sensor must be located on top of the banknote passageway. The motor bracket housing and optics housing of the present invention permit a magnetic sensor to always be located on top of the banknote passageway, regardless of which housing defines the top half of the passageway. Thus, the same validator can be used in either an up-stacker or a down-stacker configuration by merely changing the position of the magnetic sensor.

The housings support a plurality of sensors which operate to scan a bill as it passes through the banknote passageway. Optical sensors are encased in translucent support receptacles of each housing, located near the bill entryway, to prevent dirt buildup and to prevent tampering. The support receptacles directly oppose each other so that the optical sensors are in the same location independent of the orientation of the housings. This design improvement results in manufacturing advantages such as increased flexibility in meeting customer demand, and reduced part inventory requirements.

At least one optical sensor operates using infra-red wavelength signals, thus, the housings are preferably composed of a translucent red plastic material having optical characteristics such that it does not interfere with the infra-red wavelength signals. Further, at least one optical sensor transmits visible light which acts to illuminate the entryway of the validator. The illuminated entryway provides a visual aid to customers trying to locate the bill entryway.

The present invention also comprises an improved pinch roller assembly to bias a bill against the magnetic sensor. The pinch roller assembly comprises a cartridge with a channel which is round in the center but oblong at its ends, a pinch roller which rotates freely in the direction of bill travel, and a spring to bias the pinch roller towards the magnetic sensor. The channel of the pinch roller assembly can be fitted to the pulley shaft of the motor bracket if the validator is to have a down-stacker configuration, or can be fitted to the wheel shaft located on the optics bracket if the validator is to have an up-stacker configuration. Due to the design of the channel, the pinch roller assembly is capable of moving a fixed amount in the lateral direction, perpendicular to the direction of bill travel, in order to self-adjust itself to the position of an opposing magnetic sensor.

The present invention further comprises an improved motor and belt drive assembly The improvement involves the placement of an encoder disc, used to monitor bill position in the banknote passageway, directly on the drive shaft. This results in improved accuracy regarding banknote position, and minimizes position errors due to backlash when braking the motor.

The currency validator apparatus of the present invention thus provides flexibility and adaptability, reduces manufacturing costs, and achieves higher banknote handling accuracy.

DETAILED DESCRIPTION

Figure 1:
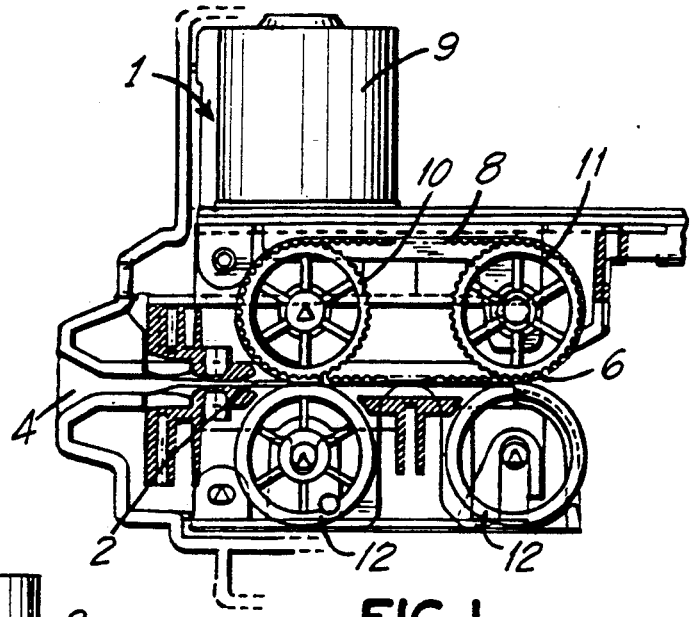
FIG. 1 is a partial cutaway side view of a currency validator apparatus according to the present application.

FIG. 1 is a side view of a presently preferred embodiment of the currency validator apparatus 1 of the present invention. The currency validator apparatus 1 contains a bill passageway 2 having an entryway 4 and an exit 6. Disposed on either side of bill passageway 2 are two continuous tractor belts 8 connected to parallel pulleys 10 and 11. The pulleys 10 are connected via a series of gears (not shown) to a motor 9. The motor controlled tractor belts 8 act to advance a bill along passageway 2 in a forward direction (from left to right in FIG. 1). The motor 9 is reversible so that it can drive the tractor belts 8 in an opposite direction, reversing the direction of travel of the bill. Positioned directly opposite each belt 8 is a set of wheels 12 which further assist the inserted bill in advancing through the bill passageway 2.

Figure 2:
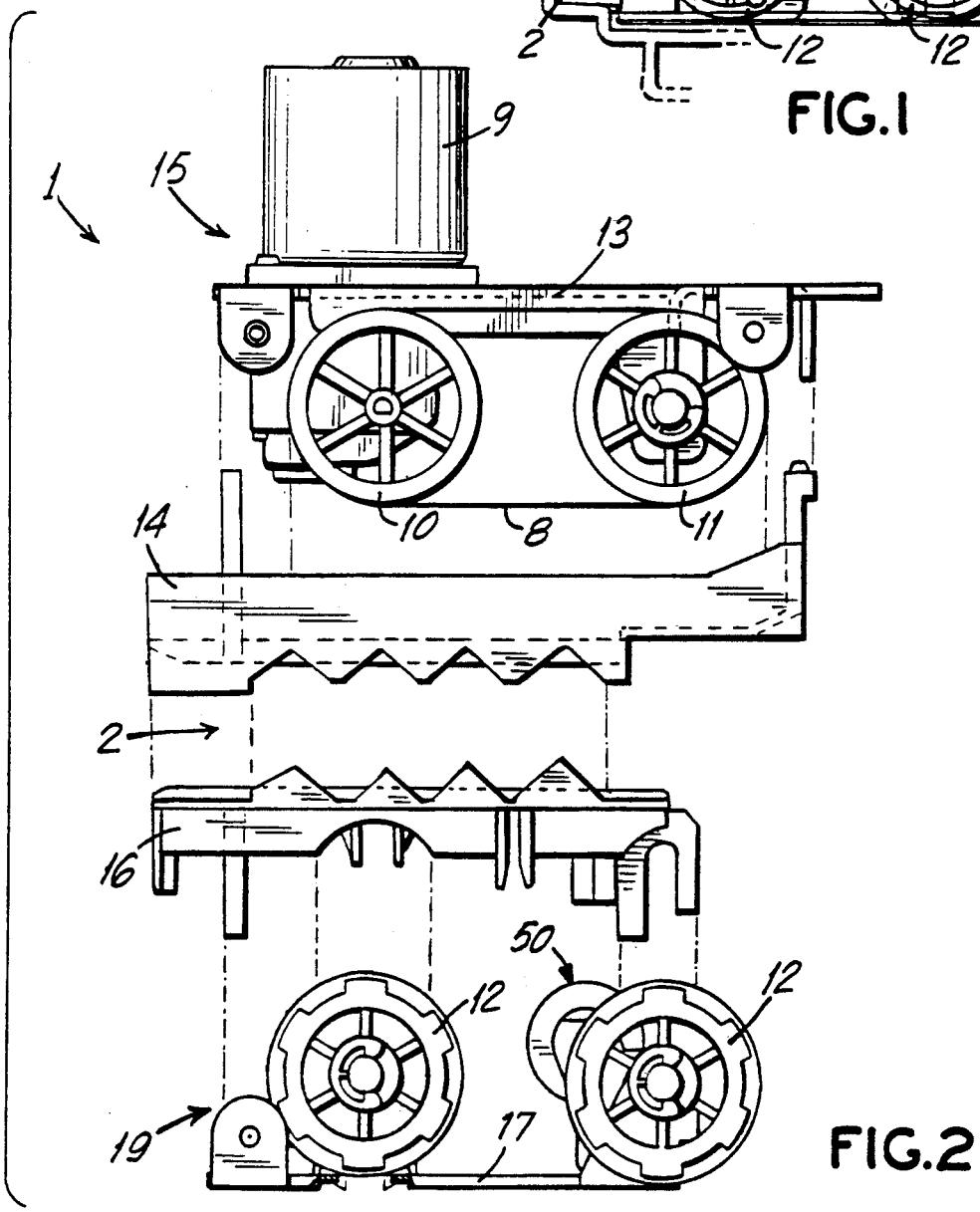
FIG. 2 is an exploded view of the components of the currency validator apparatus of FIG. 1.

FIG. 2 is an exploded view of the currency validator 1 of FIG. 1, to illustrate the interconnection of a motor bracket assembly 15, a motor bracket housing 14, an optics housing 16, and an optics bracket assembly 19. The motor bracket assembly 15 consists of a motor bracket 13 to which is connected a motor drive assembly 60 (shown in FIG. 9A) having a motor 9, the pulley wheels 10 and 11, and tractor belts 8. The optics bracket assembly 19 consists of wheels 12 and pinch roller assembly 50 (shown in FIGS. 8A and 8B) connected to optics bracket 17. The motor bracket housing 14 and optics housing 16 interlock to form the bill passageway 2 between them.

By convention in the currency validation field, a customer inserts a U.S. banknote into a validator portrait-side up. Magnetic areas of interest occur on the portrait side of a genuine U.S. banknote, therefore a magnetic sensor must be located on the top side of the bill passageway 2. One novel aspect of the present invention is that the structure of the validator apparatus 1 permits a magnetic sensor to be located in either the motor bracket housing 14 or the optics housing 16. Therefore, either housing may form the top of the bill passageway 2. Thus, the currency validator 1 may be connected to a banknote stacker in either an up-stacker or a down-stacker configuration, or may stand alone as a stacker-less unit, dependant only on vendor requirements.

Figure 3B:
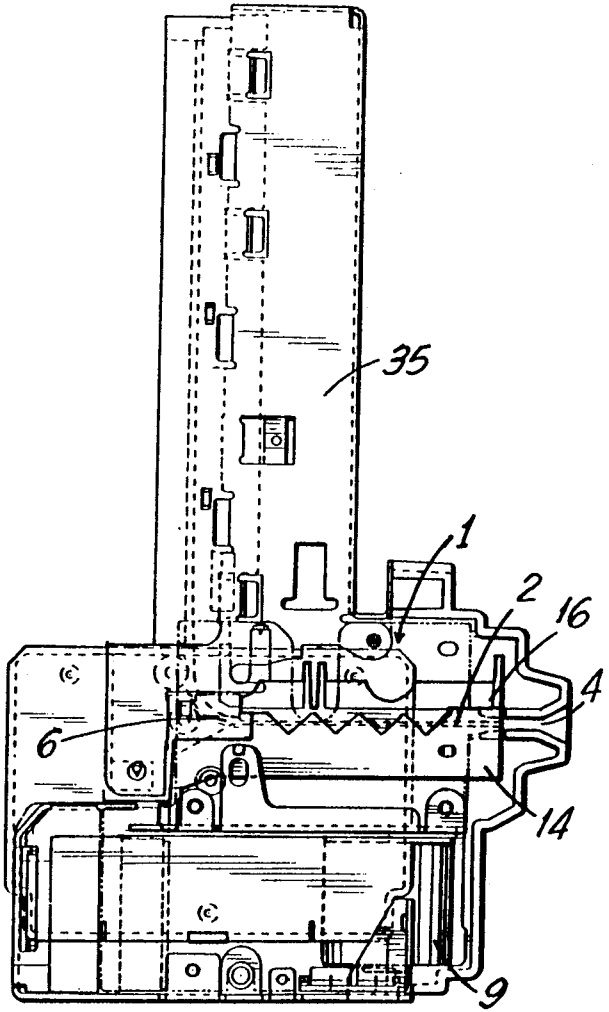
FIGS. 3A and 3B illustrate validator down-stacker and up-stacker configurations.
Figure 3A:
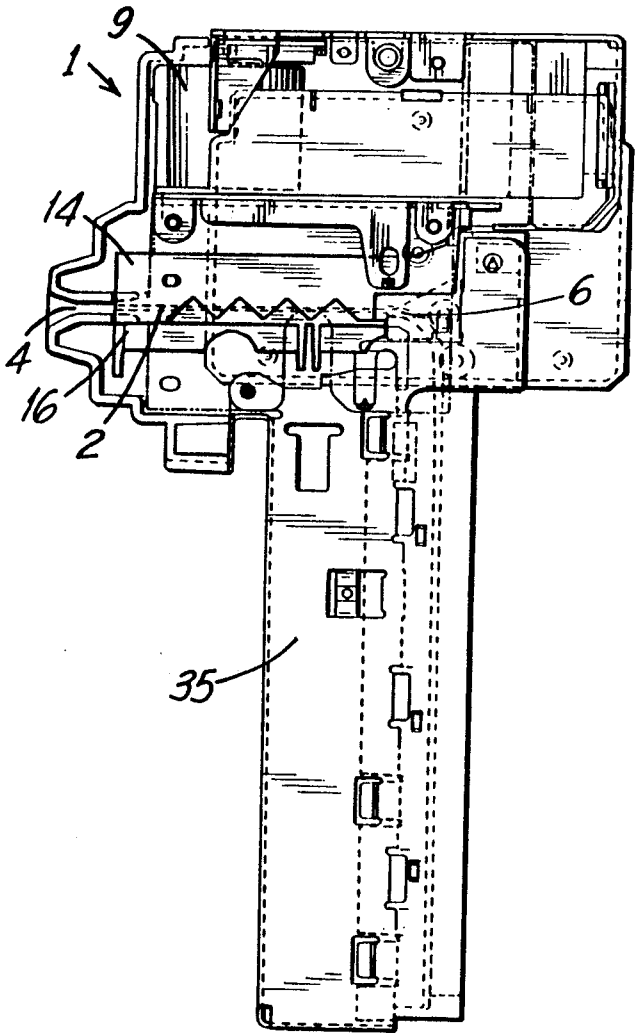

FIG. 3A is a side view of the currency validator apparatus 1 enclosed in a protective casing and connected to a stacker 35 in a down-stacker configuration. Conversely, FIG. 3B is a side view of the currency validator apparatus 1 connected to a stacker 35 in an up-stacker configuration. Like components from FIGS. 1 and 2 are numbered the same in both FIGS. 3A and 3B for easy reference. In both FIGS. 3A and 3B, the validator apparatus 1 is connected to the stacker 35 in the same manner, however, the positions of the motor bracket housing 14, optics housing 16, motor bracket assembly 15, and optics bracket assembly 19 are reversed. As will be discussed further below, the motor bracket housing 14 and optics bracket housing 16 each contain openings to permit a magnetic sensor to be positioned on top of the banknote passageway 2. Consequently, the magnetic sensor is located in motor bracket housing 14 in the down-stacker configuration of FIG. 3A, and is located in the optics housing 16 in the up-stacker configuration of FIG. 3B.

The details of the stacker 35 of FIGS. 3A and 3B pertaining to stacking paper currency are not part of this invention, and those aspects are not discussed further below. Various aspects of the structure of the validator apparatus which concern the configuration of the unit as a down-stacker or as an up-stacker do form a part of this invention and are further described below. As an example of suitable electrical and mechanical interconnections of a validator to a stacker, see U.S. Pat. No. 4,765,607, assigned to the assignee of the present invention and incorporated by reference herein.

A currency validator according to the present invention has a plurality of sensors positioned along the bill passageway 2 to generate electrical signals in response to certain features of the bill. The details regarding the use of optical and magnetic sensors to validate and denominate paper currency are not part of this invention, and are not discussed further below. However, various aspects of the structure of the validator concerning the positioning of these sensors do form a part of this invention, and are further described below. An example of a validator employing various sensors to validate and denominate paper currency is U.S. Pat. No. 4,628,194, assigned to the assignee of the present application and incorporated by reference herein.

Figure 4:
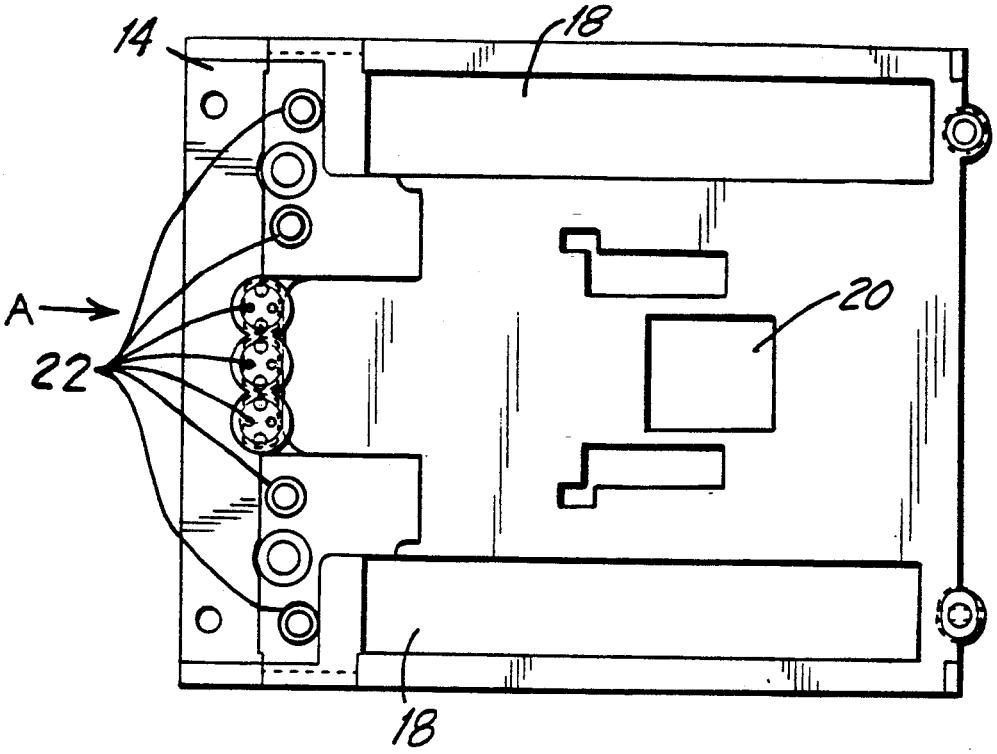
FIG. 4 is a top view of a motor bracket housing of the currency validator.

FIG. 4 is a top view of the motor bracket housing 14 shown in FIG. 2. The arrow "A" indicates the direction of bill insertion and travel through the validator. Openings 18 permit the tractor belts 8 (see FIG. 2) to contact a bill in the passageway 2. An opening 20 permits either a magnetic sensor or a pinch roller to contact a bill, and enclosed support receptacles 22 house optical sensor means.

Figure 5:
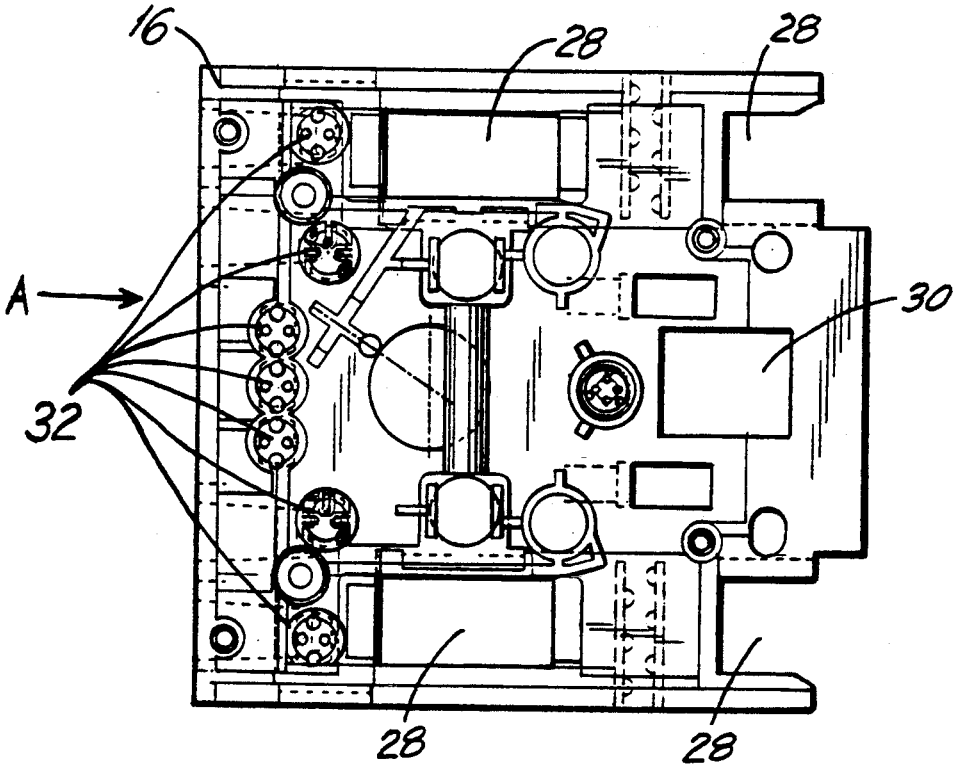
FIG. 5 is a top view of an optics housing which connects to the motor bracket housing of FIG. 4.

FIG. 5 is a top view of the optics bracket housing 16 shown in FIG. 2. The arrow "A", as above, indicates direction of bill travel through the validator. Openings 28 permit wheels 12 (see FIG. 2) to contact a bill in the banknote passageway 2. An opening 30 permits either a magnetic sensor or a pinch roller to contact a bill, and enclosed support receptacles 32 house optical sensor means.

The motor bracket housing 14 and optics housing 16 of FIGS. 4 and 5 interconnect so that the optical sensor receptacles 22 and 32 directly oppose each other across the bill passageway 2. Similarly, magnetic sensor and pinch roller openings (20, 30) directly oppose each other, as do the openings for the tractor belts and wheels (18, 28).

The optical sensors used in the validator apparatus of the present invention are encased in the housings (14, 16) to prevent dirt and other foreign matter from adhering to the sensors, and to prevent tampering. At least one optical sensor transmits and receives infra-red wavelength signals. Consequently, the motor bracket housing 14 and optics housing 16 are preferably made of translucent plastic, in particular a red translucent plastic material having optical characteristics which permit the unobstructed transmission of infra-red waves.

As shown in FIGS. 4 and 5, the optical sensor support receptacles 22, 32 are located close to the entryway 4 of the bill validator 1. At least one optical sensor transmits visible light which illuminates the entryway 4 formed by the translucent plastic housings 14, 16. When the currency validator is located in an area having low light levels, such as in a gaming casino or bar, a customer can easily locate the illuminated entryway 4 of the validator. Thus, this design provides illumination of the entryway without adding any additional components or cost.

Figure 6A:
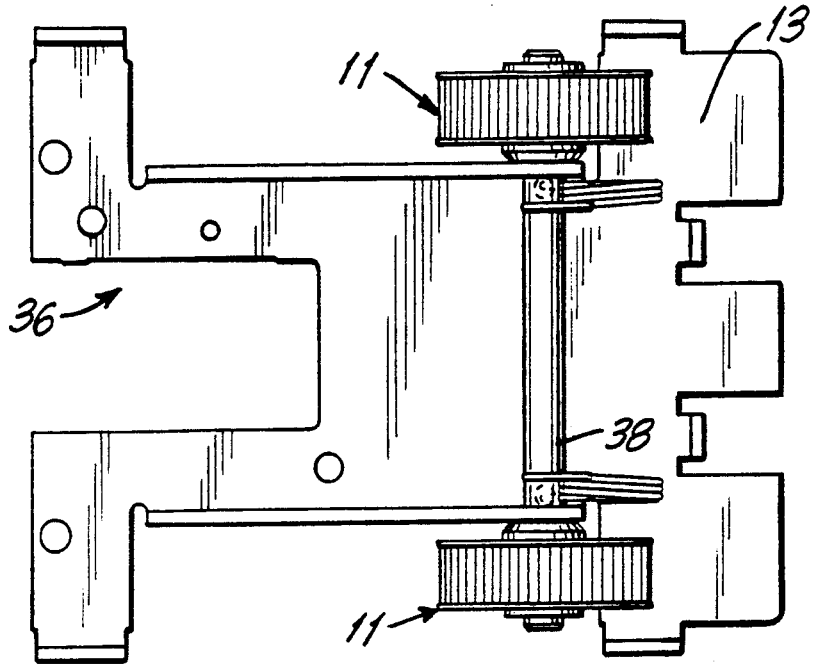
FIGS. 6A and 6B are top views, respectively, of a motor bracket and an optics bracket for use in a down-stacker configuration.
Figure 6B:
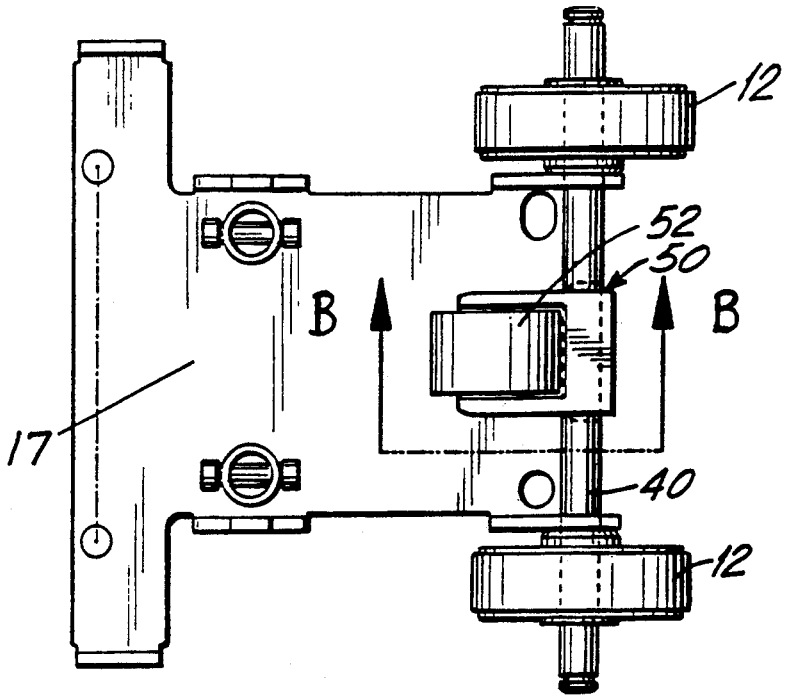

FIGS. 6A and 6B depict top views, respectively, of the motor bracket 13 and the optics bracket 17 for use in the down-stacker configuration depicted in FIG. 3A. The motor bracket 13 connects to the motor bracket housing 14 (see FIG. 2) and has a slot 36 in which a motor and belt drive assembly 60 (shown in FIG. 9A) is connected. Pulleys 11 are connected to pulley shaft 38.

FIG. 6B shows the optics bracket 17 having wheels 12 connected to a wheel shaft 40. A pinch roller assembly 50 is also connected to the wheel shaft 40. The pinch roller assembly 50 is spring-biased to bias a pinch roller wheel 52 towards a magnetic sensor.

As described above with reference to FIGS. 3A and 4, in the down-stacker configuration a magnetic sensor fits through opening 20 of motor bracket housing 14. An opposing pinch roller wheel 52, shown in FIG. 6B, fits through opening 30 of the optics housing 16. The spring biased pinch roller wheel 52 thereby acts to press the portrait side of an inserted bill firmly against the magnetic sensor to ensure accurate detection of magnetic information.

Figure 7A:
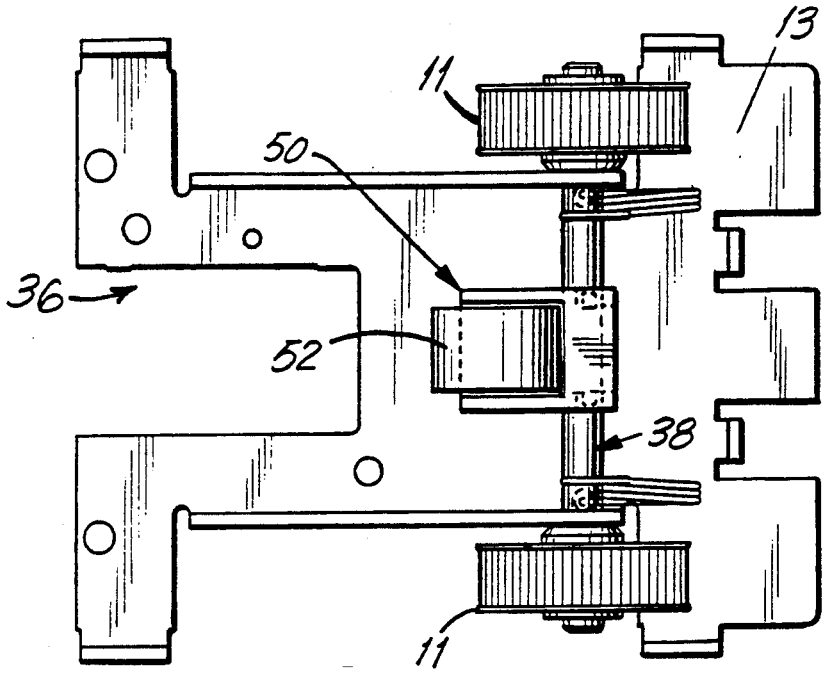
FIGS. 7A and 7B are top views, respectively, of a motor bracket and an optics bracket for use in an up-stacker configuration.
Figure 7B:
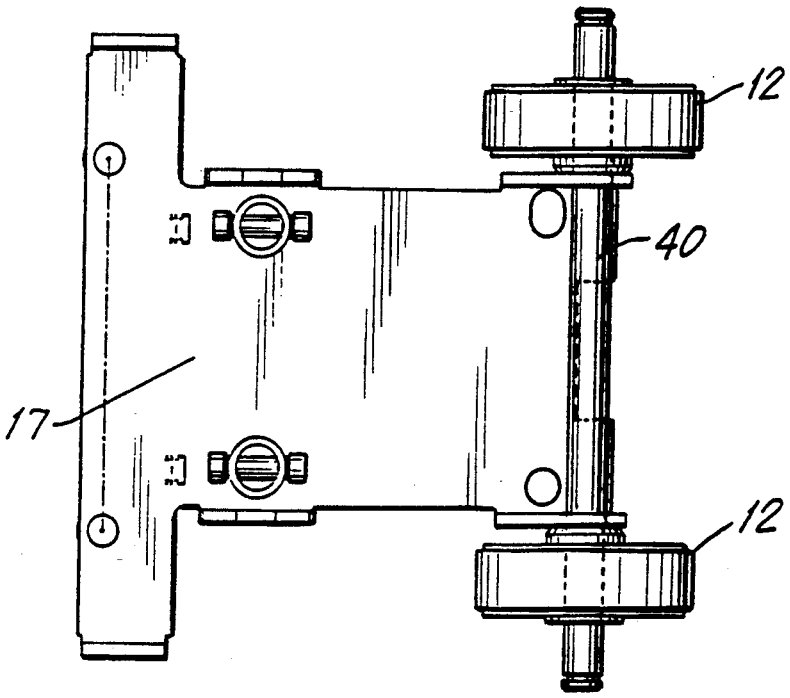

FIGS. 7A and 7B are top views, respectively, of the same motor bracket 13 and optics bracket 17 of FIGS. 6A and 6B, except that pulley shaft 38 of motor bracket 13 is now fitted with the pinch roller assembly 50.

When the bill validator apparatus 1 is connected in an up-stacker configuration, shown in FIG. 3B, the optics housing 16 now defines the top of the banknote passageway, and the motor bracket housing 14 defines the bottom. Therefore, a magnetic sensor is located in the optics housing 16 and fits through opening 30 (shown in FIG. 5), and the pinch roller wheel 52, shown in FIG. 7A, fits through opening 20 (shown in FIG. 4) of the motor bracket housing 14. As described above, the pinch roller wheel 52 is spring biased to press an inserted bill firmly against the magnetic sensor to ensure accurate detection of magnetic information.

Figure 8A:
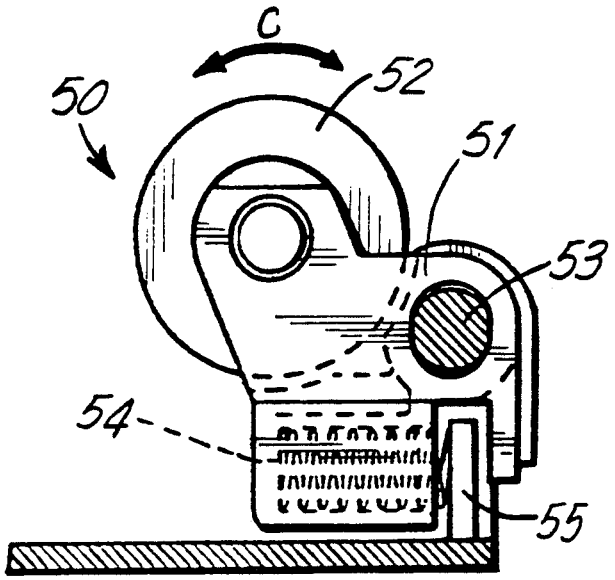
FIGS. 8A and 8B are side and front views of a pinch roller assembly.

FIG. 8A is a side view taken along line "B—B" of FIG. 6B, of the pinch roller assembly 50. The pinch roller assembly 50 comprises a cartridge 51 and a pinch roller wheel 52. The pinch roller wheel 52 rotates freely in the directions of arrow C. A spring 54, seated inside of cartridge 51, acts against a tab 55, located on either motor bracket 13 or optics bracket 17, to bias the pinch roller wheel 52 towards a magnetic sensor, as described above.

Figure 8B:
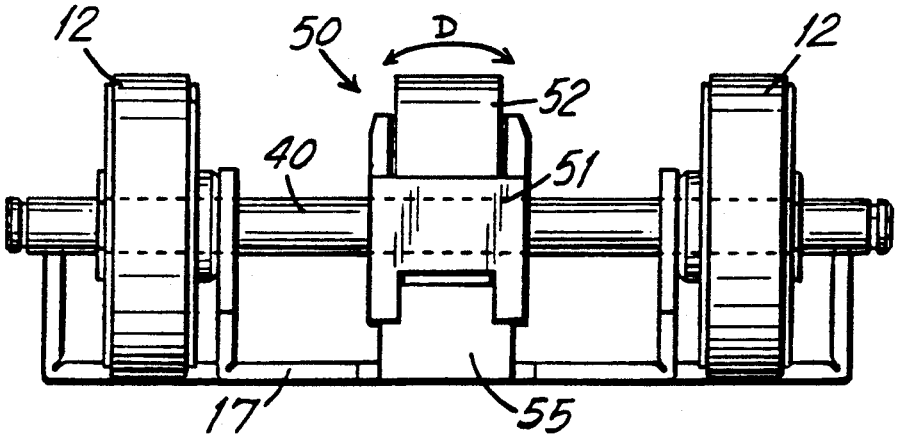

FIG. 8B is a front view of the pinch roller assembly 50, shown positioned on wheel shaft 40 of the optics bracket 17. The cartridge 51 is loosely connected to the tab 55 which prevents the pinch roller assembly 50 from sliding along the wheel shaft 40.

The pinch roller assembly 50 is designed to press a banknote firmly up against a magnetic sensor as it travels through the bill passageway 2 while avoiding several problems observed in the prior art. For example, care must be taken not to put too much pressure on a bill or jamming may occur. Another problem may occur when assembly of the components results in the magnetic sensor being seated in the housing such that it does not lie perfectly flat along the banknote passageway. In this case, incorrect sensing of an inserted bill may occur. The pinch roller assembly 50 is designed to address these problems.

Referring to FIG. 8A, the cartridge 51 has a channel 53 which is circular in the middle, and oblong at its ends. The oblong ends of the channel permit a fixed amount of lateral movement of the cartridge 51 on the shaft perpendicular to bill travel. This lateral movement, illustrated by arrow "D" in FIG. 8B, allows the pinch roller assembly 50 to self-adjust to the position of a magnetic sensor, thus improving the quality of magnetically sensed data. Further, bill jamming is minimized because the pinch roller wheel 52 does not exert excessive pressure on a bill.

Figure 9A:
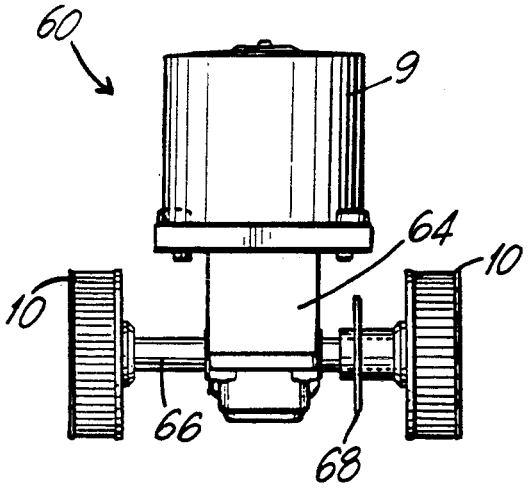
FIG. 9A is a plan view of a motor and belt drive assembly for connection to the motor bracket.

FIG. 9A is a front view of a motor and belt drive assembly 60 which fits into a motor slot 36 (shown in FIGS. 6A and 7A) of the motor bracket 13. The motor and belt drive assembly 60 comprises a motor 9, a gearbox assembly (not shown) contained within gearbox housing 64, motor drive shaft 66, encoder disc 68 and pulleys 10. Suitable gearbox and motor combinations are known to those skilled in the art, thus details will not be discussed herein. However, a novel aspect of the present invention involves the advantages realized by placement of the encoder disc 68 on the motor drive shaft 66.

When a banknote is inserted into the currency validator 1, a sensor causes the motor 9 to start. The bill is gripped between the tractor belts 8 and wheels 12 and advanced through the bill passageway 2 to encounter the optical and magnetic sensors. If the information gathered by the sensors at any given point indicates that the bill is not genuine, then the motor 9 is reversed and the bill is rejected. Data collection continues until such time as the sensors indicate that the bill transport should be stopped, usually after the last magnetic area passes the magnetic sensor, at which time the motor 9 is braked. The banknote is then validated and denominated, and the vending machine checked to see if the proper merchandise is available.

At the time the bill is stopped for validation, it is required that all magnetic areas of interest passed the magnetic sensor, and that the bill is being gripped by the tractor belts 8 and wheels 12 in case the motor is to be reversed and the bill rejected. Further, it is desirable to handle paper currency in a validator as quickly as possible. Therefore, accurate monitoring of banknote position in the bill passageway 2 to guarantee correct processing is critical.

In the past, integrated motor and encoder assemblies were used to keep track of bill location. However, when the motor was braked, the pulleys 10 and tractor belts 8 sometimes continued to move slightly due to momentum, resulting in movement of the banknote after the motor had stopped. Since the integrated motor and encoder assembly monitored only the motor, this bill movement was not sensed which resulted in bill position errors. In addition, bill position errors occurred due to backlash attributed to the gearing of the motor drive train when the motor was braked. As the motor assembly aged the backlash problem increased causing even worse positioning errors.

Figure 9B:
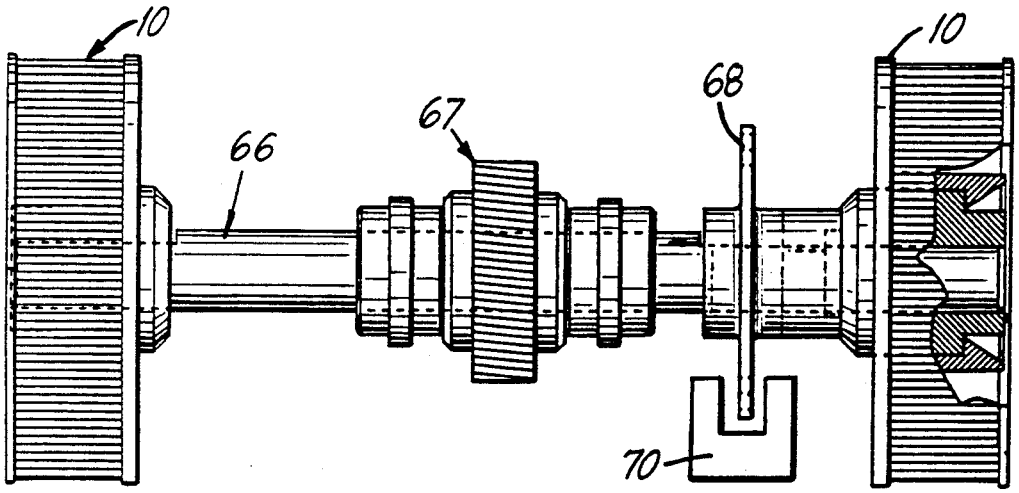
FIG. 9B is an enlarged view of the encoder and drive shaft portion of FIG. 9A.

FIG. 9B is an enlarged front view of the motor drive shaft 66, a helical gear 67 which connects to the gearbox and drives the shaft, the encoder disc 68, pulleys 10, and an optical slotted sensor 70 which is not drawn to scale. The optical slotted sensor 70 is located in the motor bracket housing 14, and operates in conjunction with the encoder disc 68 to produce signals indicative of bill position.

Figure 9C:
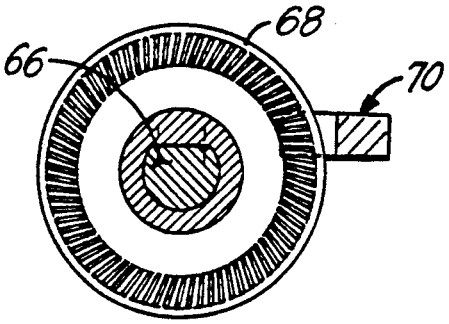
FIG. 9C is a side view of the encoder disc.

FIG. 9C is an enlarged side view of the encoder disc 68, showing a cutaway view of optical slotted sensor 70. The drive shaft 66 shown in FIGS. 9A and 9B, and in cross-section in FIG. 9C, is designed to fit snugly through the encoder disc 68 so that rotation cannot occur unless the drive shaft 66 rotates. A similar connection to the pulleys 10 prevents their rotation unless the drive shaft 66 rotates.

According to the present invention, when the motor 9 is braked the movement of the pulley 10 is monitored. The present design pinpoints bill position in the banknote passageway 2 to within four one-hundredths of an inch. Thus, this arrangement provides greater bill position accuracy, and further minimizes bill position errors due to backlash.

The present invention provides an improved currency validator apparatus capable of being configured as either an up-stacker or a down-stacker dependent entirely on customer requirements. Alternatively, the validator may be assembled as a stacker-less unit. This novel validator design results in manufacturing advantages such as increased flexibility in meeting customer demand, and cost savings due to reduced part inventory requirements. Further, changes can be made to a validator in the field if required. In addition, an improved pinch roller assembly enhances the ability of the validator to accurately sense magnetic data on a bill. Further, the improved motor and belt drive assembly which employs an encoder on the drive shaft improves validator efficiency and accuracy regarding bill position in the banknote passageway. Consequently, the method and apparatus of the present invention provides an economical, efficient and more accurate validator.

While the present invention has been described in connection with the preferred embodiment thereof, it should be understood that other embodiments may fall within the spirit and scope of the invention as disclosed.

I claim:

1. An improved currency validator comprising:

a first housing and a second housing which interconnect to form a banknote passageway therebetween, wherein the first and second housings terminate in interconnection means for connection to a banknote stacker;

a single magnetic sensor positioned on top of the banknote passageway, wherein the first housing accommodates the magnetic sensor when the stacker is in the down position, and wherein the second housing accommodates the magnetic sensor when the stacker is in the up position; and a pinch roller for biasing currency towards the magnetic sensor, wherein the pinch roller is connected below the banknote passageway and wherein the pinch roller comprises a cartridge containing a channel which is circular at its center and oblong at its ends, a pinch roller wheel connected to the cartridge which freely rotates in the direction of travel of a bill, and a spring located in the cartridge.

2. The apparatus of claim 1 further comprising:

an optics bracket assembly for connection to the second housing, wherein the optics bracket assembly supports the pinch roller when the stacker is connected in a down position.

3. The apparatus of claim 1 further comprising:

a motor bracket assembly for connection to the first housing, wherein the motor bracket assembly supports the pinch roller when the stacker is connected in an up position.

4. The apparatus of claim 1, wherein the first housing and the second housing are made of a translucent plastic and contain optical sensors.

5. The apparatus of claim 3, wherein a motor and belt drive assembly connects to the motor bracket assembly, said motor and belt drive assembly comprising:

a motor and motor housing;

a gearbox and gearbox housing connected to the motor;

a motor drive shaft connected to the gearbox;

an encoder disc connected to the motor drive shaft;

pulley wheels connected to the motor drive shaft; and tractor belts connected to the pulley wheels to transport an inserted banknote, and wherein an optical slotted sensor monitors the encoder disc to provide accurate data regarding banknote position.

6. An improved pinch roller assembly comprising:

a cartridge having a channel for connection to a shaft, wherein the channel is circular at its center and oblong at its ends such that a small amount of lateral motion of the pinch roller assembly is possible;

a freely rotatable pinch roller wheel connected to the cartridge; and a spring located in the cartridge to bias the pinch roller wheel toward an opposing signal generating sensor means, wherein the pinch roller assembly can self-adjust to the position of the opposing signal generating sensor means.

* * * * *